US009022610B2

(12) United States Patent
Mar

(10) Patent No.: US 9,022,610 B2
(45) Date of Patent: May 5, 2015

(54) LIGHTING APPARATUS WITH ADJUSTABLE LIGHT BEAM

(71) Applicant: Technomate Manufactory Limited, KLN (HK)

(72) Inventor: Cheuk Yin Mar, KLN (HK)

( * ) Notice: Subject to any disclaimer, the term of this patent is extended or adjusted under 35 U.S.C. 154(b) by 0 days.

(21) Appl. No.: 14/033,541

(22) Filed: Sep. 23, 2013

(65) Prior Publication Data

US 2015/0085491 A1 Mar. 26, 2015

(51) Int. Cl.

| | |
|---|---|
| ***F21V 19/02*** | (2006.01) |
| ***F21V 13/04*** | (2006.01) |
| ***F21K 99/00*** | (2010.01) |
| ***F21V 7/00*** | (2006.01) |

(52) U.S. Cl.

CPC . *F21V 13/04* (2013.01); *F21K 9/50* (2013.01); *F21V 7/00* (2013.01)

(58) Field of Classification Search

CPC ..... F21V 19/02
USPC ..... 362/285
See application file for complete search history.

(56) References Cited

U.S. PATENT DOCUMENTS

2012/0140478 A1* 6/2012 Householder et al. ..... 362/281
2012/0236564 A1* 9/2012 Lee ..... 362/285

* cited by examiner

*Primary Examiner* — Donald Raleigh
(74) *Attorney, Agent, or Firm* — Prakash Nama; Global IP Services. PLLC

(57) ABSTRACT

The present invention is a lighting apparatus with adjustable light beam which includes an outer reflector, an inner optical element, a light source assembly, and a transparent mounting member. The light source assembly is movable between an upper position in which the light source is positioned close to the inner optical element lower end so that a majority of light from the light source exits the lighting apparatus directly via the inner optical element to attain a wide floodlight and a lower position in which the light source is positioned close to the outer reflector lower end so that in comparison with the upper position, a decreasing amount of light exits the lighting apparatus directly via the inner optical element, and an increasing amount of light exits the lighting apparatus via reflection from the outer reflector to attain a narrow beam.

6 Claims, 5 Drawing Sheets

LIGHTING APPARATUS WITH ADJUSTABLE LIGHT BEAM

BACKGROUND OF THE INVENTION

The present invention generally relates to a lighting apparatus and more particularly to a lighting apparatus with adjustable light beam.

Lighting apparatuses such as headlights, flashlights, work lights, lanterns and so forth are typically classified according to their lighting effects, namely spotlight effect in which the light beam is narrow, and floodlight effect in which the light beam is wide. For a given light source intensity, spotlight effect provides a stronger and more concentrated lighting effect than floodlight effect. However, such lighting effect is not desirable at times when users need to illuminate a wider area; in that case, floodlight effect is more desirable. The marketplace therefore anticipates for lighting apparatuses which could provide both spotlight and floodlight effects.

BRIEF SUMMARY OF THE INVENTION

The object of the present invention is to provide a lighting apparatus with adjustable light beam.

To attain this, the present invention comprises:

an outer reflector having an outer reflector optical axis, an outer reflector upper end and an outer reflector lower end;

an inner optical element having an inner optical axis and an inner optical element lower end, wherein the inner optical element is securely mounted inside the outer reflector in a manner that the inner optical axis is coaxial with the outer reflector optical axis and the inner optical element lower end is at a position between the outer reflector upper end and the outer reflector lower end; and a light source assembly securely mounted with a light source, wherein the light source assembly is movable between an upper position in which the light source is positioned close to the inner optical element lower end so that a majority of light from the light source exits the lighting apparatus directly via the inner optical element to attain a wide floodlight and a lower position in which the light source is positioned close to the outer reflector lower end so that in comparison with the upper position, a decreasing amount of light exits the lighting apparatus directly via the inner optical element, and an increasing amount of light exits the lighting apparatus via reflection from the outer reflector to attain a narrow beam.

In one embodiment, the inner optical element is in form of a plano-convex lens; alternatively, the inner optical element is in form of an inner reflector. The inner reflector has a reflective outer surface.

In one embodiment, the inner optical element is securely mounted inside the outer reflector by means of a transparent mounting member having a base portion and a frusto conical portion extended upwardly from the base portion; the inner optical element is coupled to the base portion, and the frusto conical portion has an upper end which couples to the outer reflector upper end.

In one embodiment, the light source assembly comprises an LED base with an outer cylindrical portion and an inner cylindrical portion; the outer cylindrical portion has a platform from which the inner cylindrical portion extended upward and a shoulder portion which engages with a limiting member in an inner surface of the lighting apparatus; the inner cylindrical portion has an upper end for securely mounting the light source.

In one embodiment, the light source is positioned at a focal point common to both the outer reflector and the inner optical element at the lower position so that the outer reflector and the inner optical element collimates light from the light source.

The present invention attains the function of light beam adjustment by adjusting the position of the light source. This is different from the prior art in which the function of light beam adjustment is attained by adjustment of the position of the reflectors. It is usually easier and more convenient to adjust the position of the light source instead of reflectors, thus a simpler mechanism could be used for the adjustment and production of the present invention is thus easier.

DETAILED DESCRIPTION OF THE INVENTION

Figure 1:
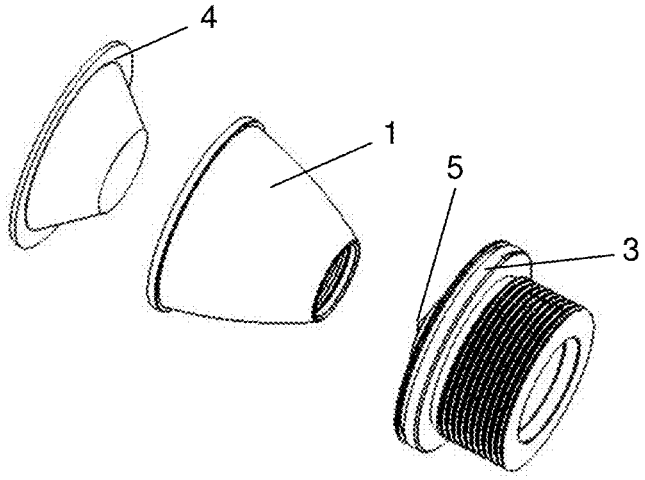
FIG. 1 is an exploded diagram illustrating the major components of the first embodiment of the present invention.
Figure 2:
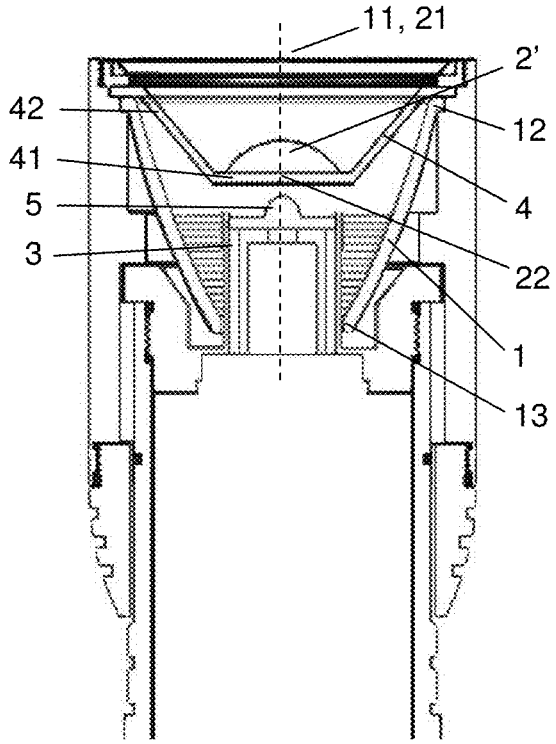
FIG. 2 is a cross sectional diagram showing the light source assembly of the first embodiment of the present invention at the upper position.
Figure 3:
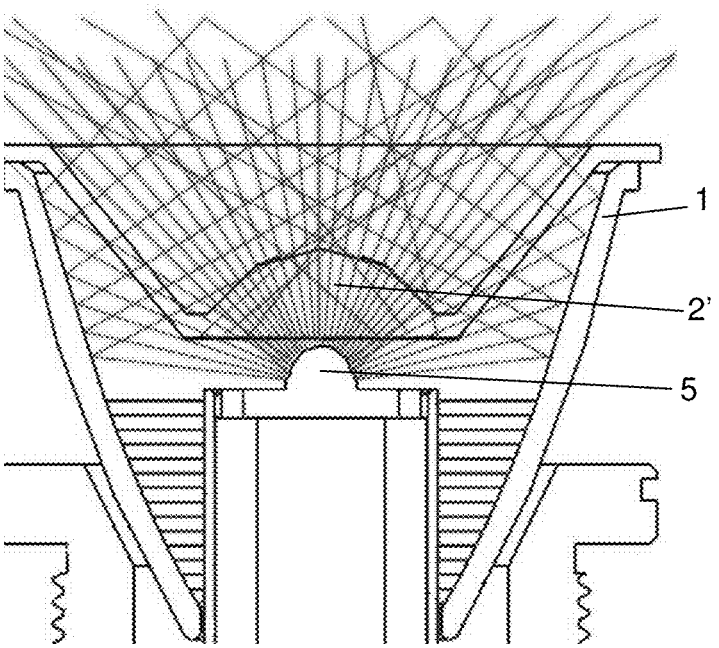
FIG. 3 is a diagram illustrating the paths of light rays in the upper position of the first embodiment of the present invention.
Figure 4:
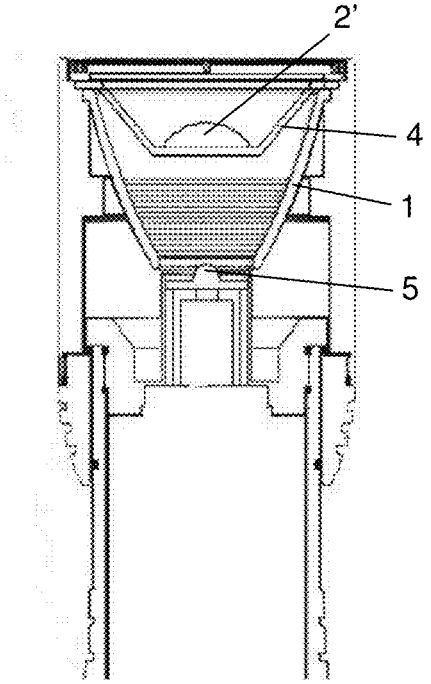
FIG. 4 is a cross sectional diagram showing the light source assembly of the first embodiment of the present invention at the lower position.
Figure 5:
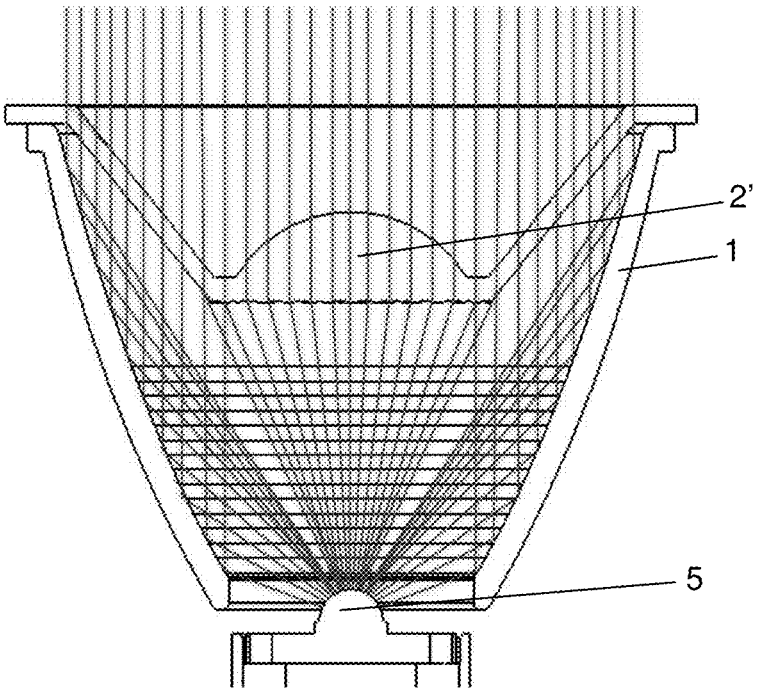
FIG. 5 is a diagram illustrating the paths of light rays in the upper position of the first embodiment of the present invention at the lower position.

The present invention will be explained in details below with reference to the accompanying drawing and specific embodiments:

As illustrated in FIGS. 1-5, the first embodiment of the present invention is in form of a flashlight. In other embodiments, other forms of lighting apparatuses such as headlight, work light, lantern and so forth are possible. The present embodiment comprises an outer reflector 1, an inner optical element being a plano-convex lens 2', a light source assembly 3, and a transparent mounting member 4. The outer reflector 1 has an outer reflector optical axis 11, an outer reflector upper end 12 and an outer reflector lower end 13. The plano-convex lens 2' has an inner optical axis 21 and an inner optical element lower end 22. The plano-convex lens 2' is securely mounted inside the outer reflector 1 in a manner that the inner optical axis 21 is coaxial with the outer reflector optical axis 11 and the inner optical element lower end 22 is at a position between the outer reflector upper end 12 and the outer reflector lower end 13. The light source assembly 3 is securely mounted with a light source 5 which is an LED in this embodiment. The light source assembly 3 is movable between an upper position in which the light source 5 is positioned close to the inner optical element lower end 22 so that a majority of light from the light source 5 exits the flashlight directly via the plano-convex lens 2' to attain a wide floodlight and a lower position in which the light source 5 is positioned close to the outer reflector lower end 13 so that in comparison with the upper position, a decreasing amount of light exits the flashlight directly via the plano-convex lens 2', and an increasing amount of light exits the flashlight via reflection from the outer reflector 1 to attain a narrow beam. The plano-convex lens 2' is securely mounted inside the outer reflector 1 by means of the transparent mounting member 4 having a base portion 41 and a frusto conical portion 42 extended upwardly from the base portion 41. The plano-convex lens 2' is coupled to the base portion 41, and the frusto conical portion 42 has an upper end which couples to the outer reflector upper end 12. In this embodiment, the light source 5 is positioned at a focal point common to both the outer reflector 1 and the plano-convex lens 2' at the lower position so that the outer reflector 1 and the plano-convex lens 2' collimates light from the light source 5.

Figure 6:
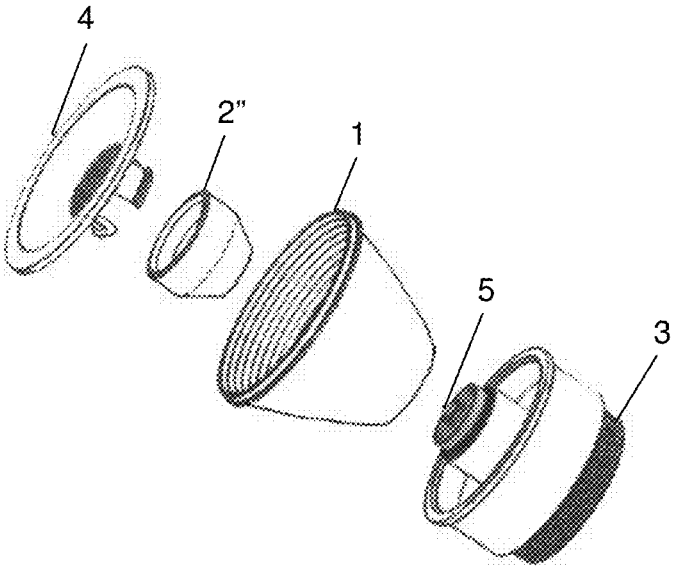
FIG. 6 is an exploded diagram illustrating the major components of the second embodiment of the present invention.
Figure 7:
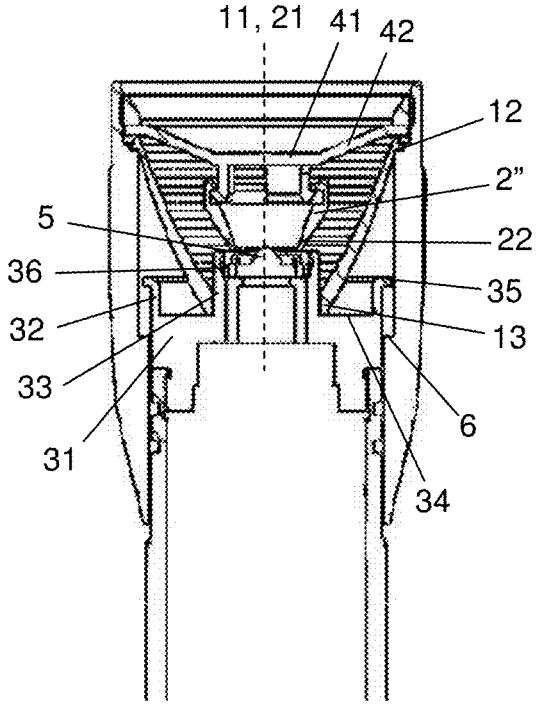
FIG. 7 is a cross sectional diagram showing the light source assembly of the second embodiment of the present invention at the upper position.
Figure 8:
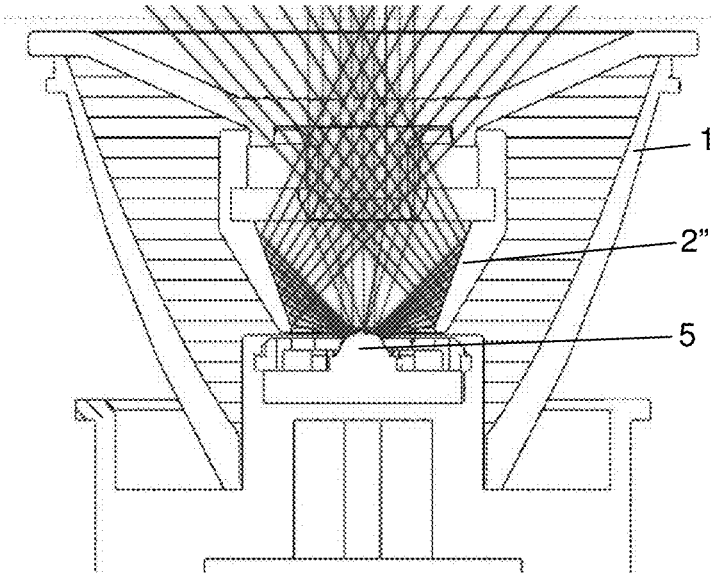
FIG. 8 is a diagram illustrating the paths of light rays in the upper position of the second embodiment of the present invention.
Figure 9:
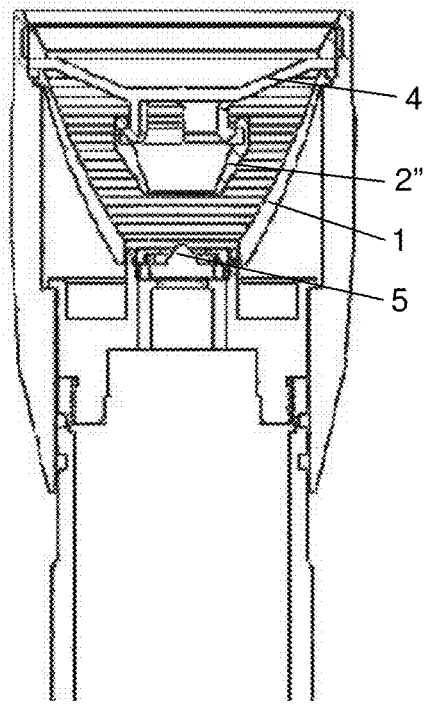
FIG. 9 is a cross sectional diagram showing the light source assembly of the second embodiment of the present invention at the lower position.
Figure 10:
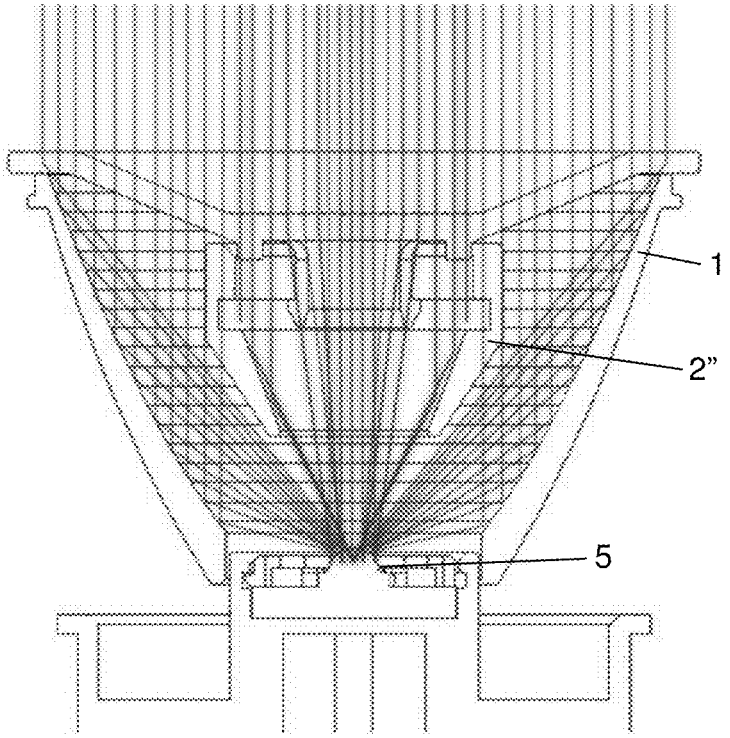
FIG. 10 is a diagram illustrating the paths of light rays in the upper position of the second embodiment of the present invention at the lower position.

As illustrated in FIGS. 6-10, the second embodiment of the present invention, which is also a flashlight, comprises an outer reflector 1, an inner optical element being an inner reflector 2" with a reflective outer surface, a light source assembly 3, and a transparent mounting member 4. The outer reflector 1 has an outer reflector optical axis 11, an outer reflector upper end 12 and an outer reflector lower end 13. The inner reflector 2" has an inner optical axis 21 and an inner optical element lower end 22. The inner reflector 2" is securely mounted inside the outer reflector 1 in a manner that the inner optical axis 21 is coaxial with the outer reflector optical axis 11 and the inner optical element lower end 22 is at a position between the outer reflector upper end 12 and the outer reflector lower end 13. The light source assembly 3 is securely mounted with a light source 5 which is an LED in this embodiment. The light source assembly 3 is movable between an upper position in which the light source 5 is positioned close to the inner optical element lower end 22 so that a majority of light from the light source 5 exits the flashlight directly via the inner reflector 2" to attain a wide floodlight and a lower position in which the light source 5 is positioned close to the outer reflector lower end 13 so that in comparison with the upper position, a decreasing amount of light exits the flashlight directly via the inner reflector 2", and an increasing amount of light exits the flashlight via reflection from the outer reflector 1 to attain a narrow beam. The inner reflector 2" is securely mounted inside the outer reflector 1 by means of the transparent mounting member 4 having a base portion 41 and a frusto conical portion 42 extended upwardly from the base portion 41. The inner reflector 2" is coupled to the base portion 41, and the frusto conical portion 42 has an upper end which couples to the outer reflector upper end 12. In this embodiment, the light source 5 is positioned at a focal point common to both the outer reflector 1 and the inner reflector 2" at the lower position so that the outer reflector 1 and the inner reflector 2" collimates light from the light source 5. In this embodiment, the light source assembly 3 comprises an LED base 31 with an outer cylindrical portion 32 and an inner cylindrical portion 33; the outer cylindrical portion 32 has a platform 34 from which the inner cylindrical portion 33 extended upward and a shoulder portion 35 which engages with a limiting member 6 in an inner surface of the flashlight. The inner cylindrical portion 33 has an upper end 36 for securely mounting the light source 5.

The above embodiments are preferred forms of the present invention. However, the present invention is not limited by the above embodiments. Any substantive or fundamental changes, modifications, replacements, combinations or simplification within the spirit of the present invention are equivalent alternatives and they are all included in the scope of protection of the present invention.

What is claimed is:

1. A lighting apparatus with adjustable light beam which comprises an outer reflector having an outer reflector optical axis, an outer reflector upper end and an outer reflector lower end;

an inner optical element having an inner optical axis and an inner optical element lower end, wherein the inner optical element is securely mounted inside the outer reflector in a manner that the inner optical axis is coaxial with the outer reflector optical axis and the inner optical element lower end is at a position between the outer reflector upper end and the outer reflector lower end; and a light source assembly securely mounted with a light source, wherein the light source assembly is movable between an upper position in which the light source is positioned close to the inner optical element lower end so that a majority of light from the light source exits the lighting apparatus directly via the inner optical element to attain a wide floodlight and a lower position in which the light source is positioned close to the outer reflector lower end so that in comparison with the upper position, a decreasing amount of light exits the lighting apparatus directly via the inner optical element, and an increasing amount of light exits the lighting apparatus via reflection from the outer reflector to attain a narrow beam;

the inner optical element is securely mounted inside the outer reflector by means of a transparent mounting member having a base portion and a frusto conical portion extended upwardly from the base portion; the inner optical element is coupled to the base portion, and the frusto conical portion has an upper end which couples to the outer reflector upper end.

2. The lighting apparatus as in claim 1, wherein the inner optical element is in form of a plano-convex lens.

3. The lighting apparatus as in claim 1, wherein the inner optical element is in form of an inner reflector.

4. The lighting apparatus as in claim 3, wherein the inner reflector has a reflective outer surface.

5. The lighting apparatus as in claim 1, wherein the light source assembly comprises an LED base with an outer cylindrical portion and an inner cylindrical portion; the outer cylindrical portion has a platform from which the inner cylindrical portion extends upward and a shoulder portion which engages with a limiting member in an inner surface of the lighting apparatus; the inner cylindrical portion has an upper end for securely mounting the light source.

6. The lighting apparatus as in claim 1, wherein the light source is positioned at a focal point common to both the outer reflector and the inner optical element at the lower position so that the outer reflector and the inner optical element collimates light from the light source.

* * * * *